US006612811B2

(12) United States Patent
Morgan et al.

(10) Patent No.: US 6,612,811 B2
(45) Date of Patent: Sep. 2, 2003

(54) AIRFOIL FOR A TURBINE NOZZLE OF A GAS TURBINE ENGINE AND METHOD OF MAKING SAME

(75) Inventors: Clive A. Morgan, Cincinnati, OH (US); Todd S. Heffron, Indian Springs, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/015,313

(22) Filed: Dec. 12, 2001

(65) Prior Publication Data

US 2003/0108423 A1 Jun. 12, 2003

(51) Int. Cl.[7] ..... F04D 29/58
(52) U.S. Cl. ..... 416/97 R; 164/369; 29/889.721
(58) Field of Search ..... 415/115, 116; 416/96 R, 96 A, 97 R; 164/369, 132; 29/889.2, 889.7, 889.72, 889.71

(56) References Cited

U.S. PATENT DOCUMENTS 5,599,166 A * 2/1997 Deptowicz et al. ..... 416/97 R
5,662,160 A 9/1997 Correia et al. ..... 164/516
5,713,722 A 2/1998 Correia et al. ..... 416/241 R
6,062,817 A 5/2000 Danowski et al. ..... 416/97 R
6,095,750 A 8/2000 Ross et al. ..... 415/189
6,126,400 A 10/2000 Nichols et al. ..... 416/241 B
6,183,192 B1 2/2001 Tressler et al. ..... 415/115

* cited by examiner

*Primary Examiner*—Edward K. Look
*Assistant Examiner*—Dwayne J. White
(74) *Attorney, Agent, or Firm*—William Scott Andes; James P. Davidson

(57) ABSTRACT

An airfoil for a turbine nozzle assembly of a gas turbine engine includes an outer side wall, an inner side wall, a leading edge extending from the outer side wall to the inner side wall, a trailing edge extending from the outer side wall to the inner side wall, a concave surface extending from the leading edge to the trailing edge on a pressure side of the airfoil, a convex surface extending from the leading edge to the trailing edge on a suction side of the airfoil, an outer cooling slot, an inner cooling slot, and at least one middle cooling slot formed in the concave side of the airfoil adjacent the trailing edge. Each of the cooling slots further includes a recessed wall, an inner slot side wall, an outer slot side wall, an inner corner fillet located between the inner slot side wall and the recessed wall, and an outer corner fillet located between the outer slot side wall and the recessed wall, wherein one of the inner and outer corner fillets for at least one of the inner and outer cooling slots forms a variable contour from an opening in the concave surface to an exit plane of the trailing edge cooling slots.

20 Claims, 6 Drawing Sheets

AIRFOIL FOR A TURBINE NOZZLE OF A GAS TURBINE ENGINE AND METHOD OF MAKING SAME

BACKGROUND OF THE INVENTION

The present invention relates generally to a turbine nozzle for a gas turbine engine and, in particular, to an airfoil utilized therein having at least one of an inner cooling slot and an outer cooling slot at the trailing edge thereof configured to have a variable fillet between a recessed wall and a side wall so as to reduce stress on the airfoil.

It will be appreciated that a nozzle segment for the high pressure turbine of a gas turbine engine typically includes a pair of hollow airfoils with integral inner and outer flowpath bands. These pieces are cast separately, partially machined, brazed together, and subsequently finish machined to form the nozzle segment. The hollow airfoil is fed internally with cooling air which then flows through trailing edge slots that exit the aft cavity of the airfoil and discharges through openings in the trailing edge of the airfoil. This cooling air then performs convection cooling as it passes along the trailing edge slot within the airfoil. When such air discharges to the flowpath through the openings in the airfoil trailing edge, it provides film cooling for the airfoil trailing edge.

Turbine airfoils with trailing edge cooling slots inherently have a step between the slot and the rib between the slots. It has been found that the step in the cooling slot closest to the nozzle bands at the inner and outer airfoil/flowpath intersection causes a large stress concentration with high thermal stresses present, which can then result in trailing edge axial cracks. The cracks ultimately propagate through the airfoil section and lead to premature failure of the turbine nozzles. The cooling slot itself cannot be removed since overheating of the trailing edge of the airfoil would result.

Moreover, the step is difficult to grind smooth because of its proximity to the airfoil/band junction.

It will be understood that the hollow airfoil cavities and trailing edge cooling slots are formed during a casting process by ceramic core which is produced separately and combined with a wax pattern prior to casting. On previous designs, corner fillets for the trailing edge slot are created by the ceramic core and minimized in order to reduce slot blockage and maintain cooling flow area. During manufacturing, however, the ceramic core is subjected to auto-finishing to remove unwanted core material around the core die splitline. It has been found that this process often removes some, if not all, of the external corner fillet on the core and results in a sharp internal corner in the finished casting. This corner acts as a stress concentration and can initiate cracking of the airfoil trailing edge.

It will be recognized that an attempt to address a similar problem for a turbine blade in a gas turbine engine is disclosed in U.S. Pat. No. 6,062,817, entitled "Apparatus and Methods For Cooling Slot Step Elimination," which is also owned by the assignee of the present invention. A turbine blade is disclosed therein where at least a portion of a step between an airfoil trailing edge slot and a platform is eliminated. An airfoil core utilized to cast the turbine blade includes a tab for forming a continuous and smooth contour from a first trailing edge slot recessed wall to a juncture of the airfoil. In this way, stress concentration is reduced, thereby improving the longevity and performance of the turbine blade.

Thus, in light of the foregoing, it would be desirable for an improved airfoil design to be developed for use with a turbine nozzle which reduces stress concentrations at the steps of the cooling slots located adjacent the inner and outer nozzle bands without adversely affecting the cooling flow from such slots. It would also be desirable to modify the core utilized so as to eliminate the opportunity for additional stress concentrations created by the auto-finishing manufacturing process.

BRIEF SUMMARY OF THE INVENTION

In a first exemplary embodiment of the invention, an airfoil for a turbine nozzle assembly of a gas turbine engine is disclosed as including an outer side wall, an inner side wall, a leading edge extending from the outer side wall to the inner side wall, a trailing edge extending from the outer side wall to the inner side wall, a concave surface extending from the leading edge to the trailing edge on a pressure side of the airfoil, a convex surface extending from the leading edge to the trailing edge on a suction side of the airfoil, an outer cooling slot, an inner cooling slot, and at least one middle cooling slot formed in the concave side of the airfoil adjacent the trailing edge. Each of the cooling slots also includes a recessed wall, an inner slot side wall, an outer slot side wall, an inner corner fillet located between the inner slot side wall and the recessed wall, and an outer corner fillet located between the outer slot side wall and the recessed wall, wherein one of the inner and outer corner fillets of at least one of the inner and outer cooling slots forms a variable contour from an opening in the concave surface to an exit plane of the trailing edge cooling slots. More specifically, the corner fillet forming the variable contour is radiused in a first plane substantially perpendicular to the slot exit plane from the opening to the exit plane. The airfoil also includes a junction between the corner fillet forming the variable contour and an end portion of the airfoil, wherein the junction is radiused in a second plane substantially perpendicular to the slot exit plane from the opening to the exit plane.

In a second exemplary embodiment of the invention, an airfoil core for a turbine airfoil is disclosed as including a wedge channel for forming a hollow portion of an airfoil and a plurality of fingers extending from the wedge channel, wherein at least one of the fingers located at an end is configured to have a distal portion with a predetermined radius from a first side wall to a second side wall. The distal portion of the finger is radiused in a first plane substantially perpendicular to an axis through the finger and radiused in a second plane substantially parallel to the axis through the finger.

In a third exemplary embodiment of the invention, a method of fabricating an airfoil of a turbine nozzle is disclosed as including the steps of inserting a mold within a die and injecting a slurry into the die. An airfoil is formed that includes an outer side wall, an inner side wall, a leading edge extending from the outer side wall to the inner side wall, a trailing edge extending from the outer side wall to the inner side wall, a concave surface extending from the leading edge to the trailing edge on a pressure side of the airfoil, a convex surface extending from the leading edge to the trailing edge on a suction side of the airfoil, and a plurality of cooling slots formed in the concave side of the airfoil adjacent the trailing edge, each of the cooling slots further including a recessed wall and a pair of slot side walls, and a variable contour for a corner fillet between the recessed wall and one of the slot side walls of a cooling slot adjacent at least one of the inner and outer side walls of the airfoil from an opening in the concave surface to an exit plane of the trailing edge cooling slots. In this way, the corner fillet is formed with a radius in a first plane substantially perpendicular to the slot exit plane that gradually increases from a minimum radius at the opening to a maximum radius at the slot exit plane. The method also includes the step of forming a junction between the corner fillet and an end portion of the airfoil, wherein the junction is radiused in a second plane substantially perpendicular to the slot exit plane from the opening to the exit plane.

DETAILED DESCRIPTION OF THE INVENTION

Figure 1:
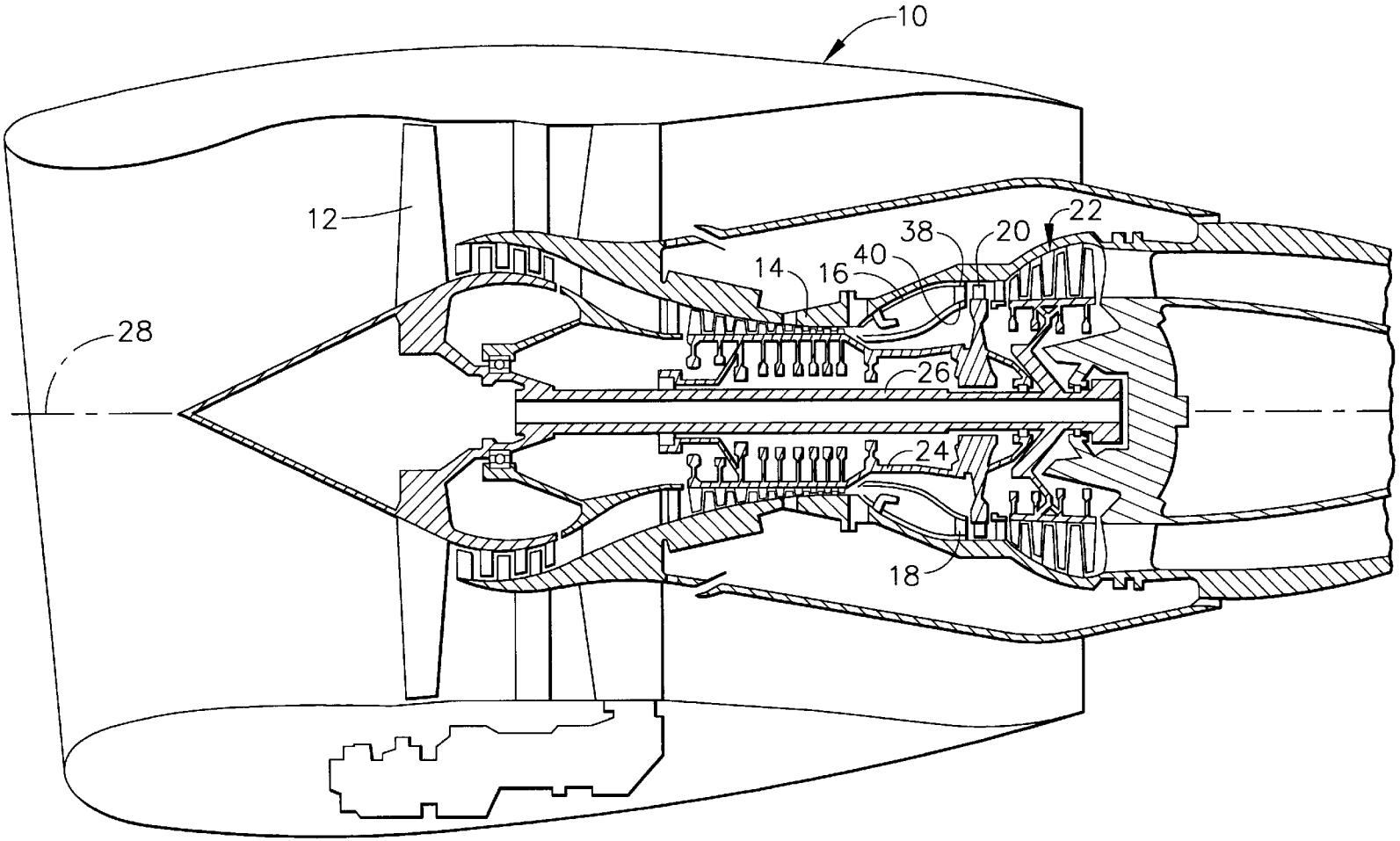
FIG. 1 is a cross-sectional view of a gas turbine engine including a turbine nozzle in accordance with the present invention.

Referring now to the drawings in detail, wherein identical numerals indicate the same elements throughout the figures, FIG. 1 depicts an exemplary turbofan gas turbine engine 10 having in serial flow communication a conventional fan 12, a high pressure compressor 14, and a combustor 16. Combustor 16 conventionally generates combustion gases that are discharged therefrom through a high pressure turbine nozzle assembly 18, from which the combustion gases are channeled to a conventional high pressure turbine 20 and, in turn, to a conventional low pressure turbine 22. High pressure turbine 20 drives high pressure compressor 14 through a suitable shaft 24, while low pressure turbine 22 drives fan 12 through another suitable shaft 26, all disposed coaxially about a longitudinal or axial centerline axis 28.

Figure 2:
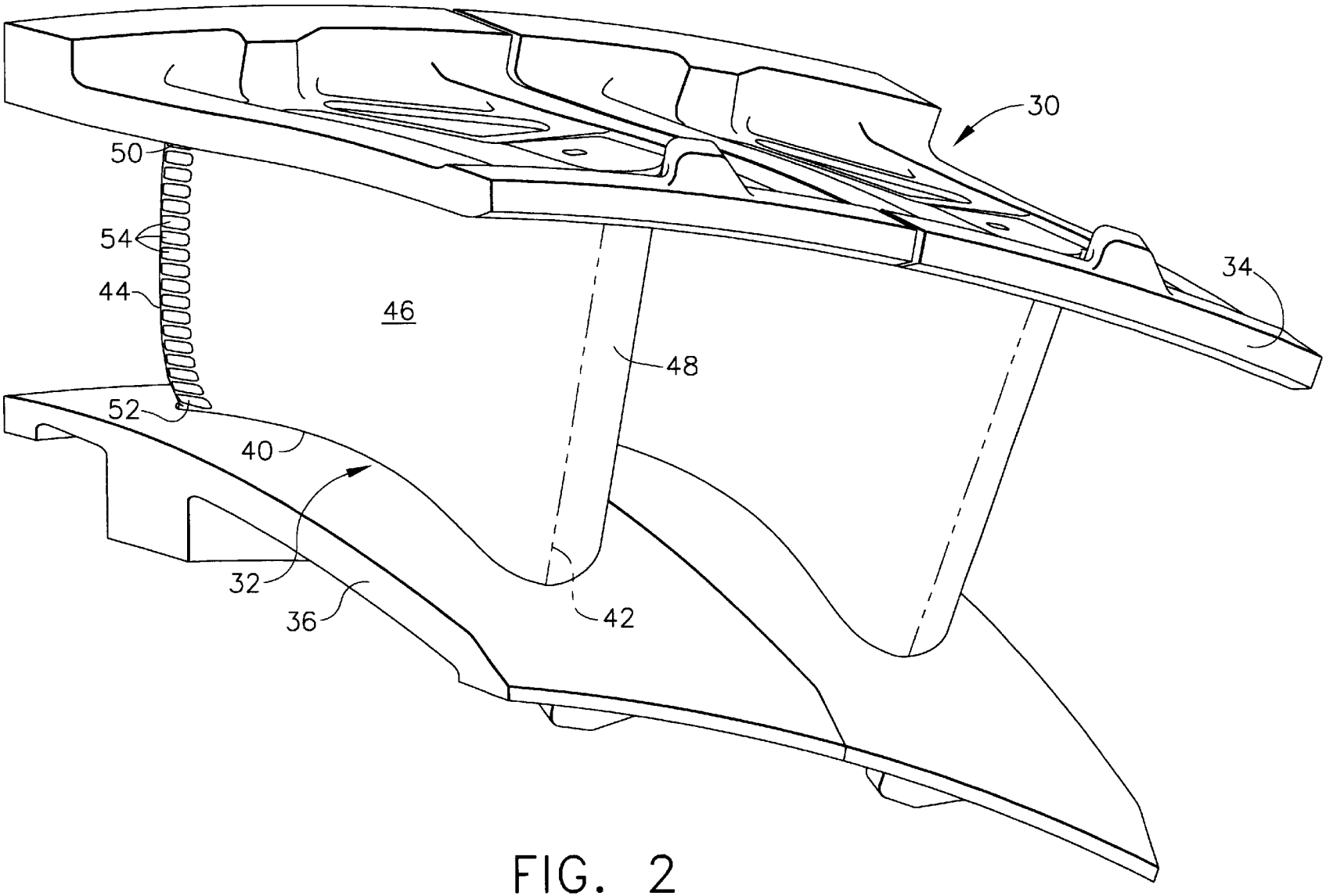
FIG. 2 is an enlarged, perspective view of a segment of the turbine nozzle depicted in FIG. 1.

Referring now to FIG. 2, it will be understood that turbine nozzle 18 preferably includes a plurality of circumferentially adjoining nozzle segments 30 to collectively form a complete 360° assembly. Each nozzle segment 30 preferably has two or more circumferentially spaced airfoils 32 which are connected to an arcuate radially outer band 34 and an arcuate radially inner band 36. More specifically, each airfoil 32 includes an outer side wall 38 whose surface lies adjacent to outer band 34, an inner side wall 40 whose surface lies adjacent to inner band 36, a leading edge 42 extending from outer side wall 38 to inner side wall 40, a trailing edge 44 extending from outer side wall 38 to inner side wall 40, a concave surface 46 extending from leading edge 42 to trailing edge 44 on a pressure side of airfoil 32, and a convex surface 48 extending from leading edge 42 to trailing edge 44 on a suction side of airfoil 32.

As seen in FIG. 2, airfoils 32 further include an outer cooling slot 50 located adjacent outer band 34, an inner cooling slot 52 located adjacent inner band 36, and at least one middle cooling slot 54 located between outer and inner cooling slots 50 and 52, respectively. It will be appreciated from FIGS. 3–6 that each of cooling slots 50, 52 and 54 is formed by a recessed wall 56, an inner slot side wall 58, an outer slot side wall 60, an inner corner fillet 62 located between inner slot side wall 58 and recessed wall 56, and an outer corner fillet 64 located between outer slot side wall 60 and recessed wall 56. The inner and outer slot walls 58 and 60 are generally provided by adjacent ribs 61 interposed between each cooling slot, but it will be seen that a rib 63 is used to provide outer slot side wall 60 for inner cooling slot 52 and an inner portion 78 of airfoil 32 (discussed in greater detail hereinafter) provides inner slot side wall 58 thereof.

Figure 3:
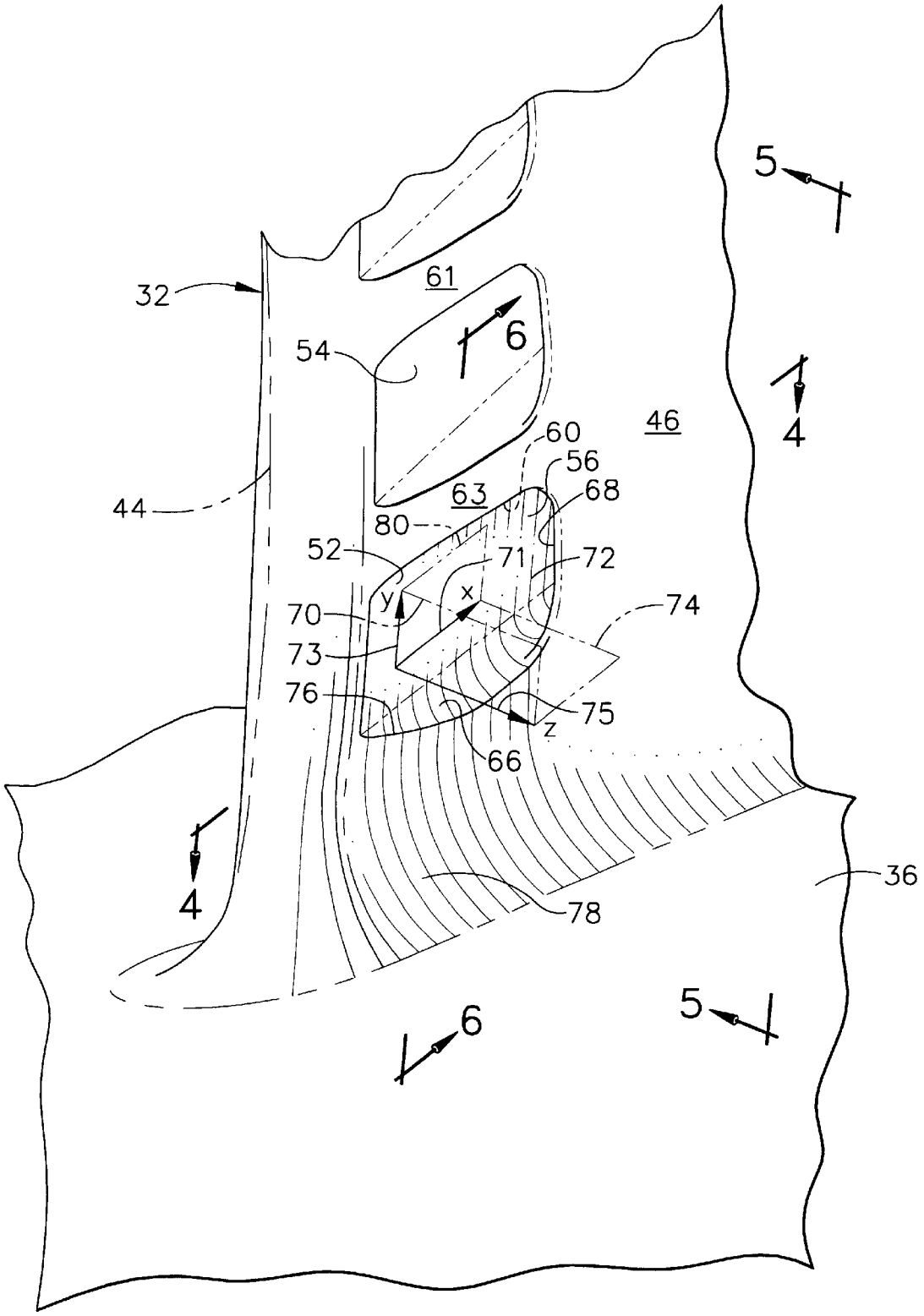
FIG. 3 is an enlarged, partial perspective view of an airfoil and the inner band of the turbine nozzle depicted in FIG. 2.
Figure 4:
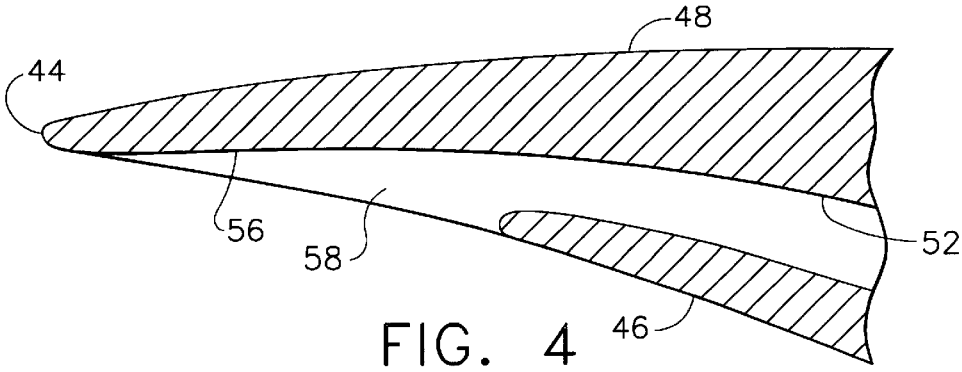
FIG. 4 is a partial sectional view of the airfoil depicted in FIG. 3 taken along line 4—4.
Figure 5:
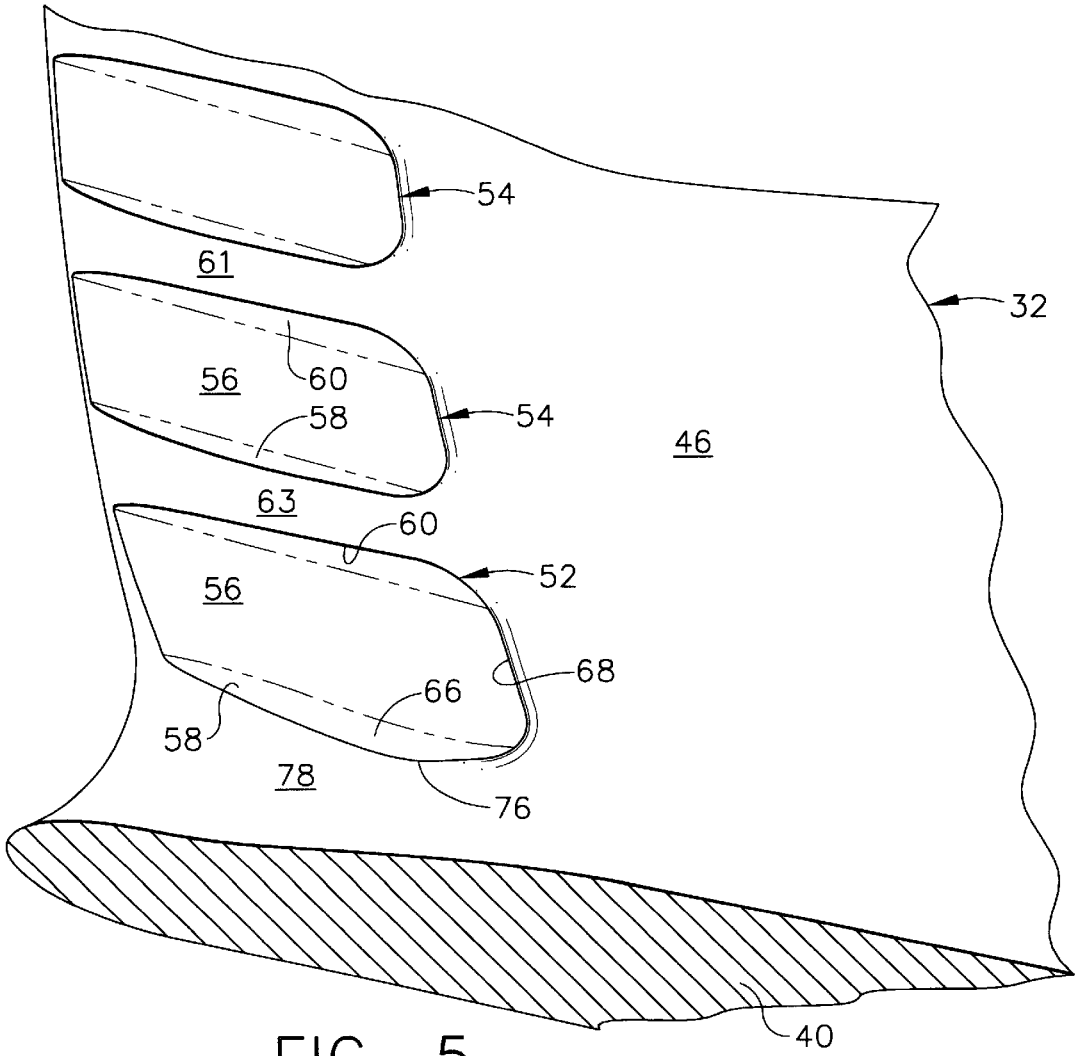
FIG. 5 is a partial plan view of the airfoil depicted in FIG. 3 taken along line 5—5.

In accordance with the present invention, it is preferred that at least one of inner corner fillet 62 for inner cooling slot 52 and outer corner fillet 64 for outer cooling slot 50 form a variable contour (as designated by surface 66 in FIG. 3) from an opening 68 in concave surface 46 (known in the art as the breakout) to an exit plane 70 which extends substantially perpendicular to cooling slots 50, 52 and 54. It will be seen that a coordinate system defined by an x axis 71, a y axis 73 and a z axis. 75 is depicted in FIG. 3 which will be utilized to define various planes discussed herein. As such, exit plane 70 is defined as the extending in the y-z plane thereof.

Although depicted and described herein with respect to inner corner fillet 62 for inner cooling slot 52, the present invention can be, and preferably is, applied in mirror image to outer corner fillet 64 for outer cooling slot 50. As evidenced by contour lines 72 in FIG. 3, surface 66 (which may also be considered inner slot side wall 58 for inner cooling slot 52) is radiused in a first plane 74 (defined as extending in the x-z plane) which extends substantially perpendicular to slot exit plane 70 from opening 68 to slot exit plane 70. It will be appreciated from the curvature of such contour lines 72 that the radius of inner corner fillet 62 forming the variable contour gradually increases from a minimum radius $R_{min}$ at opening 68 to a maximum radius $R_{max}$ at slot exit plane 70. This is done in order to maintain the slot area, footprint and cooling characteristics for inner cooling slot 52.

Figure 6:
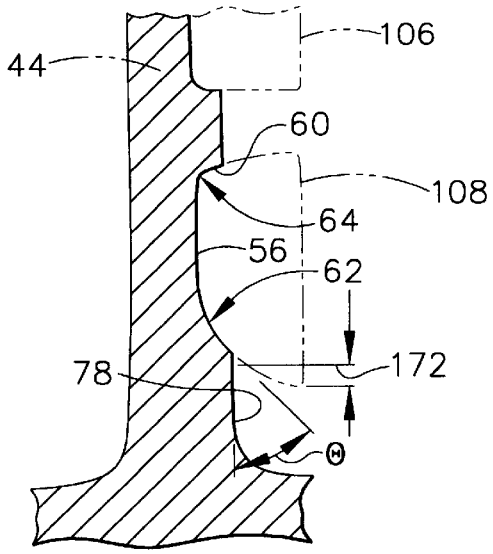
FIG. 6 is a partial sectional view of the airfoil depicted in FIG. 3 taken along line 6—6.

Further, airfoil 32 includes a junction 76 between inner corner fillet 62 and an inner portion 78 of concave surface 46, wherein junction 76 is radiused in a second plane 80 (defined as extending in the x-y plane) which extends substantially perpendicular to slot exit plane 70 (and first plane 74) from opening 68 to slot exit plane 72. As seen in FIG. 6, an angle θ between inner corner fillet 62 and inner portion 78 of airfoil 32 is established at junction 76, where such angel θ gradually decreases from a maximum angle $\theta_{max}$ at opening 68 to a minimum angle $\theta_{min}$ at slot exit plane 72. It is preferred that maximum angle $\theta_{max}$ be approximately 65°–85° and minimum angle $\theta_{min}$ be approximately 0°–10°. It will be seen that angle θ is approximately 45° at the approximate mid-point between opening 68 and slot exit plane 70 shown in FIG. 6.

In order for inner corner fillet 62 to establish the variable contour of surface 66, it will be understood that inner slot side wall 58 and recessed wall 56 of inner cooling slot 52 preferably form a continuous curve having a predetermined radius from opening 68 in concave surface 46 to slot exit plane 70 (best seen in FIG. 6). Similarly, in the case of outer cooling slot 50, outer slot side wall 60 and recessed wall 56 will preferably form a continuous curve having a predetermined radius from opening 68 in concave surface 46 to slot exit plane 70.

Figure 7:
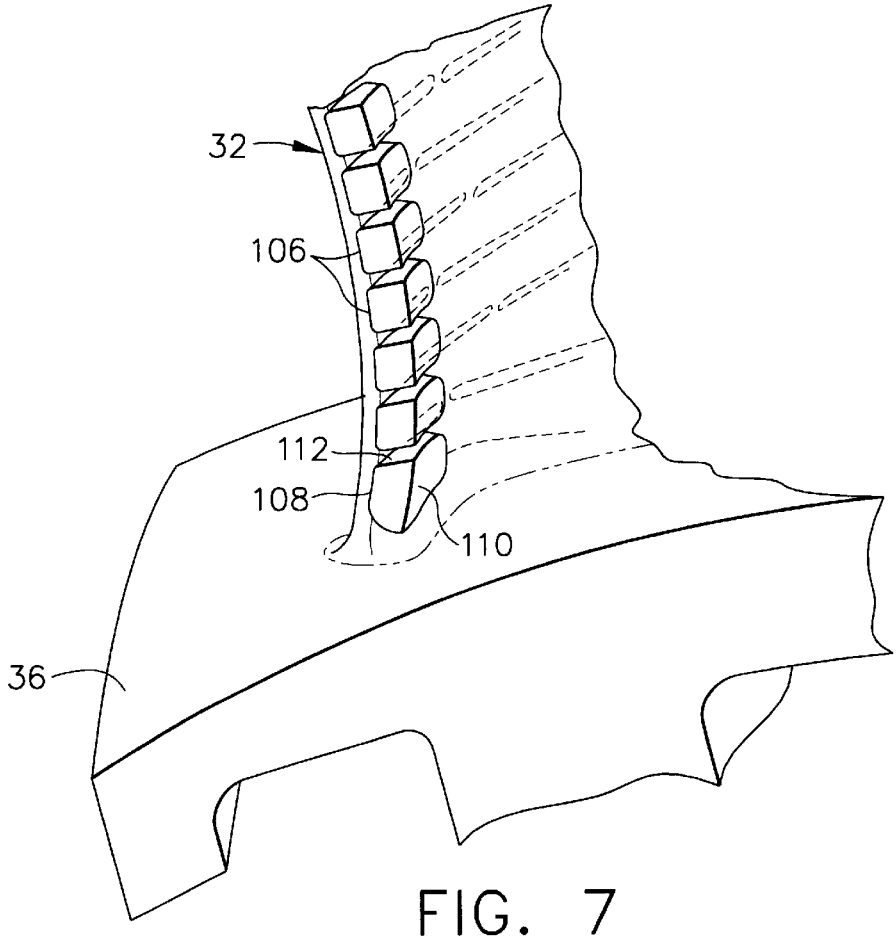
FIG. 7 is an enlarged, partial top perspective view of the airfoil depicted in FIGS. 2–6 including a core portion defining the trailing edge cooling slots in the airfoil; and, FIG. 8 is a bottom perspective view of the core utilized to define the hollow inner portion and the trailing edge cooling slots of the airfoil.
Figure 8:
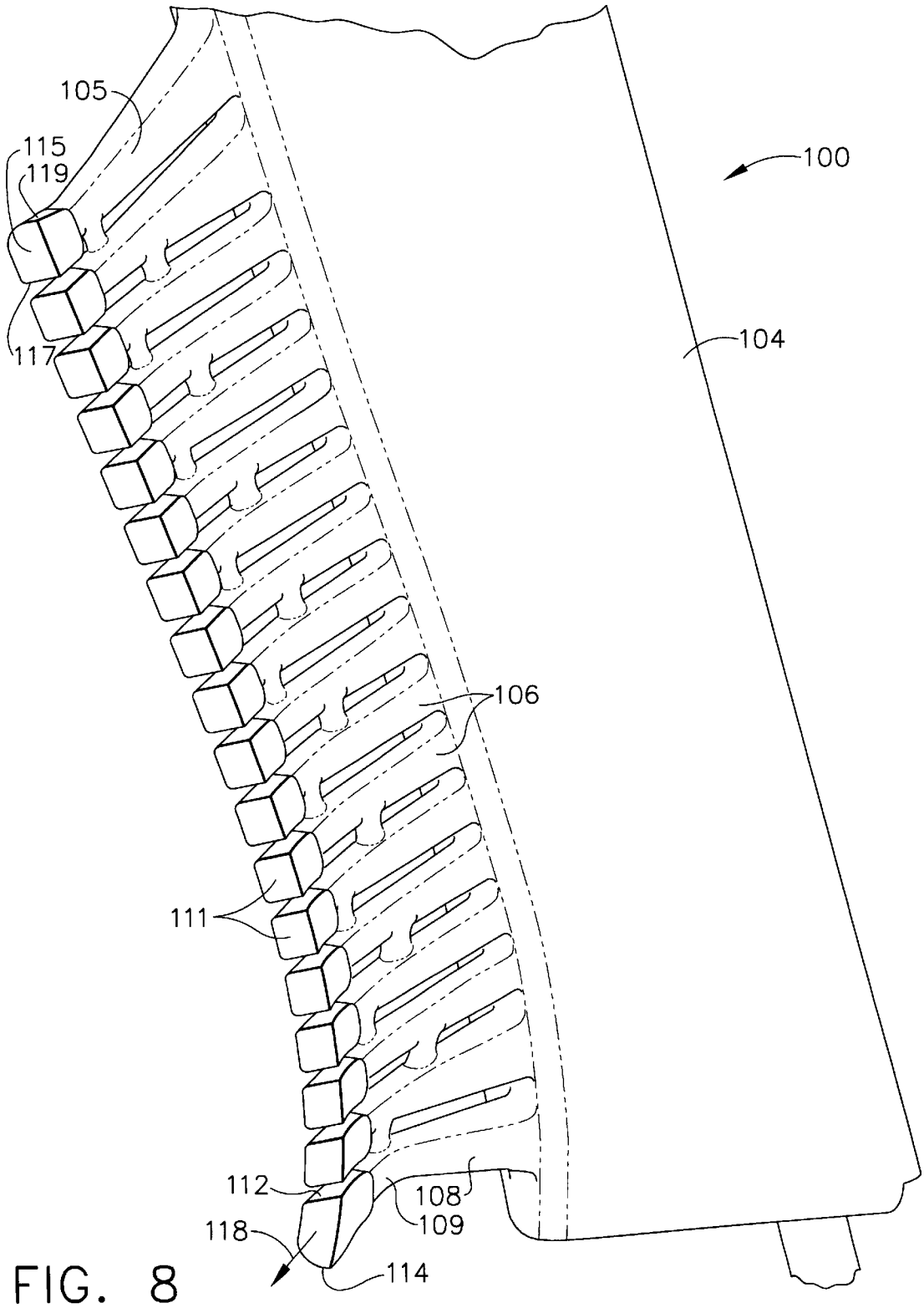

It will be understood that an airfoil core 100 is utilized to form the interior hollow portions and trailing edge cooling slots 50, 52 and 54 of airfoil 32. As seen in FIG. 8, airfoil core 100 includes a wedge channel 104, an outer finger 105, a plurality of middle fingers 106, and an inner finger 108 extending from wedge channel 104. It will be noted that inner finger 108 is utilized to form inner cooling slot 52 of airfoil 32, outer finger 105 forms outer cooling slot 50, and middle fingers 106 form middle cooling slots 54. More specifically, inner finger 108 is configured to have a stem portion 109 connected to wedge channel 104 and a distal portion 110 which has a predetermined radius from a first side wall 112 to a second side wall 114 when viewed in section (see FIGS. 6–8). Contrary to the substantially rectangular distal portions 111 of middle fingers 106, a continuous curve is established by recessed wall 56 and inner slot side wall 58 of inner cooling slot 52 as described hereinabove. Likewise, a continuous curve is established by recessed wall 56 and outer slot side wall 60 for outer cooling slot 50 in airfoil 32 since distal portion 115 of outer finger 105 preferably has a predetermined radius from a first side wall 117 to a second side wall 119 (see FIG. 8).

Accordingly, distal portion 110 of inner finger 108 is radiused in a first plane 116 (corresponding to first plane 74) substantially perpendicular to an axis 118 through inner finger 108, as well as a second plane 120 (corresponding to second plane 80) substantially parallel to axis 118. Although airfoil core 100 is discussed with respect to inner finger 108, it will be appreciated that a mirror image thereof is preferably utilized for outer finger 105 to form the preferred configuration of outer cooling slot 50 in airfoil 32.

As noted hereinabove, the nature of the forming process for airfoil core 100 results in "flash," where ceramic material escapes between two mating pieces of the die. Airfoil core 100 is then preferably finished using a small computer controlled milling machine to remove the flash. As demonstrated by dashed line 122 in FIG. 6, this finishing process can also remove a portion of the radius for finger side walls that eventually form inner and outer corner fillets 62 and 64, which has created sharp corners in previous designs. By providing fillets of variable contour in inner slot side wall 58 of inner cooling slot 52 and outer slot side wall 60 of outer cooling slot 50 in the present invention, the radius for inner corner fillet 62 and outer corner fillet 64, respectively, for such cooling slots 52 and 50 are better maintained since such corner fillets are present outside a nominal casting geometry of airfoil 32.

In accordance with a method of fabricating airfoil 32 of turbine nozzle 18, it will be understood that airfoil core 100 is held within a die so that a wax encapsulates it. A final wax pattern is produced which is a replica of the metal casting for airfoil 32, with airfoil core 100 taking the place of cavities formed in the finished part. It will be appreciated that the wax pattern is dipped in a ceramic solution and dried a number of times to build up layers which form a strong shell mold. The mold is then heated to melt out the wax and cure the ceramic so that airfoil core 100 remains within the shell to form the cavities of airfoil 32 when the mold is filled with molten metal. A molten alloy is poured into the mold, taking up the form left by the wax, with airfoil core 100 preventing the metal from entering areas that are to be cavities in the finished casting and creating the internal features. Finally, the ceramic shell is broken off the casting and the internal ceramic core 100 is leached out using a dissolving solution. The final casting of airfoil 32 thus has the external form of the wax pattern and the internal features of airfoil core 100, which preferably includes inner corner fillet 62 of inner cooling slot 52 and outer corner fillet 64 of outer cooling slot 50 as described above.

Having shown and described the preferred embodiment of the present invention, further adaptations of the airfoil 32 for a turbine nozzle 18, airfoil core 100, and the method for making such airfoil can be accomplished by appropriate modifications by one of ordinary skill in the art without departing from the scope of the invention. In particular, it will be understood that the concepts described and claimed herein could be utilized in a turbine blade and still be compatible with the present invention.

What is claimed is:

1. An airfoil for a turbine nozzle assembly of a gas turbine engine, comprising:

(a) an outer side wall;

(b) an inner side wall;

(c) a leading edge extending from said outer side wall to said inner side wall;

(d) a trailing edge extending from said outer side wall to said inner side wall;

(e) a concave surface extending from said leading edge to said trailing edge on a pressure side of said airfoil;

(f) a convex surface extending from said leading edge to said trailing edge on a suction side of said airfoil;

(g) an outer cooling slot, an inner cooling slot, and at least one middle cooling slot formed in said concave side of said airfoil adjacent said trailing edge, each of said cooling slots further including:

(1) a recessed wall;

(2) an inner slot side wall;

(3) an outer slot side wall;

(4) an inner corner fillet located between said inner slot side wall and said recessed wall; and, (5) an outer corner fillet located between said outer slot side wall and said recessed wall;

wherein one of said inner and outer corner fillets for at least one of said inner and outer cooling slots forms a variable contour from an opening in said concave surface to an exit plane of said trailing edge cooling slots.

2. The turbine nozzle of claim 1, wherein said corner fillet forming a variable contour is radiused in a first plane substantially perpendicular to said slot exit plane from said opening to said exit plane.

3. The turbine nozzle of claim 2, wherein said radius of said corner fillet forming a variable contour gradually increases from a minimum radius at said opening to a maximum radius at said exit plane.

4. The turbine nozzle of claim 1, said airfoil including a junction between said corner fillet forming a variable contour and an end portion of said airfoil, wherein said junction is radiused in a second plane substantially perpendicular to said slot exit plane from said opening to said exit plane.

5. The turbine nozzle of claim 4, wherein an angle between said corner fillet and said end portion of said airfoil at said junction gradually decreases from a maximum angle at said opening to a minimum angle at said exit plane.

6. The turbine nozzle of claim 5, wherein said maximum angle is approximately 65°–85°.

7. The turbine nozzle of claim 5, wherein said minimum angle is approximately 0°–10°.

8. The turbine nozzle of claim 1, wherein said corner fillet forming a variable contour is said outer corner fillet in said outer cooling slot.

9. The turbine nozzle of claim 1, wherein said corner fillet forming a variable contour is said inner corner fillet in said inner cooling slot.

10. The turbine nozzle of claim 8, wherein said outer side wall and said recessed wall of said outer cooling slot form a continuous curve having a predetermined radius from an opening in said concave surface to said slot exit plane.

11. The turbine nozzle of claim 9, wherein said inner side wall and said recessed wall of said inner cooling slot form a continuous curve having a predetermined radius from an opening in said concave surface to said slot exit plane.

12. An airfoil core for a turbine airfoil, comprising:

(a) a wedge channel; and (b) a plurality of fingers extending from said wedge channel, wherein at least one of said fingers located at an end is configured to have a distal portion with a predetermined radius from a first side wall to a second side wall.

13. The airfoil core of claim 12, wherein said distal portion of said end finger is radiused in a first plane substantially perpendicular to an axis through said finger.

14. The airfoil core of claim 12, wherein said distal portion of said end finger is radiused in a second plane substantially parallel to an axis through said end finger.

15. The airfoil core of claim 12, wherein said end finger is located at an outer end of said airfoil core.

16. The airfoil core of claim 12, wherein said end finger is located at an inner end of said airfoil core.

17. The airfoil core of claim 12, said radius between said end finger first and second walls being maintained after auto-finishing so that any sharp corner for a cooling slot formed therefrom is outside a nominal casting geometry of said turbine airfoil.

18. A method of fabricating an airfoil of a turbine nozzle, comprising the steps of:

(a) inserting a mold within a die;

(b) injecting a slurry into the die to form an airfoil that includes an outer side wall, an inner side wall, a leading edge extending from said outer side wall to said inner side wall, a trailing edge extending from said outer side wall to said inner side wall, a concave surface extending from said leading edge to said trailing edge on a pressure side of said airfoil, a convex surface extending from said leading edge to said trailing edge on a suction side of said airfoil, and a plurality of cooling slots formed in said concave side of said airfoil adjacent said trailing edge, each of said cooling slots further including a recessed wall and a pair of slot side walls, and a variable contour for a corner fillet between said recessed wall and one of said slot side walls of a cooling slot adjacent at least one of said inner and outer side walls from an opening in said concave surface to an exit plane of said trailing edge cooling slots.

19. The method of claim 18, wherein said corner fillet is formed with a radius in a first plane substantially perpendicular to said slot exit plane that gradually increases from a minimum radius at said opening to a maximum radius at said slot exit plane.

20. The method of claim 18, further comprising the step of forming a junction between said corner fillet and an end portion of said airfoil, wherein said junction is radiused in a second plane substantially perpendicular to said slot exit plane from said opening to said exit plane.

* * * * *